US006478066B1

(12) United States Patent
Rossi et al.

(10) Patent No.: US 6,478,066 B1
(45) **Date of Patent: *Nov. 12, 2002**

(54) CORRUGATOR UNIT, PARTICULARLY FOR SHEETS OR WEBS OF PAPER, OR SIMILAR

(75) Inventors: Renato Rossi, Biassono (IT); Flavio Pompeo Lucca, Merate (IT)

(73) Assignee: Agnati S.p.A., Vimercate (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/113,506

(22) Filed: Jul. 10, 1998

(30) Foreign Application Priority Data

Jul. 11, 1997 (IT) ..... SV97A0036

(51) Int. Cl.[7] ..... B31F 1/26

(52) U.S. Cl. ..... 156/472; 425/369; 425/336

(58) Field of Search ..... 156/205, 210, 156/462, 470, 472, 473, 582, 471; 425/369, 336, 370, 373; 72/196

(56) References Cited

U.S. PATENT DOCUMENTS

| | | | | |
|---|---|---|---|---|
| 1,186,998 A | * | 6/1916 | Lanston | |
| 1,519,280 A | * | 12/1924 | Wandel | |
| 1,642,782 A | * | 9/1927 | Langston | 425/369 |
| 3,192,560 A | * | 7/1965 | Huffman | 425/373 |
| 3,382,133 A | | 5/1968 | Healy | |
| 3,527,638 A | | 9/1970 | Sonnichsen | |
| 3,973,894 A | | 8/1976 | Lindner et al. | 425/370 |
| 4,046,612 A | | 9/1977 | Warner et al. | 156/205 |
| 4,531,996 A | | 7/1985 | Sukenik | 156/472 |
| 4,874,457 A | | 10/1989 | Swieringa | 156/474 |
| 5,344,520 A | * | 9/1994 | Seki et al. | 156/472 |
| 5,628,865 A | | 5/1997 | Marschke | |
| 5,630,903 A | * | 5/1997 | Knorr et al. | 156/472 |
| 5,632,850 A | * | 5/1997 | Knorr et al. | 156/472 |
| 5,951,816 A | | 9/1999 | Marschke | 156/472 |
| 6,012,501 A | * | 1/2000 | Marschke | 156/472 |

* cited by examiner

*Primary Examiner*—Michael W. Ball
*Assistant Examiner*—Gladys Piazza
(74) *Attorney, Agent, or Firm*—James Creighton Wray; Meera P. Narasimhan

(57) ABSTRACT

A corrugator unit, particularly for sheets or webs of paper, or similar, of the type comprising at least two rolls (1, 2), having a toothed or corrugated surface (101, 202), and being mutually engaged and pushed against each other by a predetermined pressure or force. The invention provides that the mutual compression between rolls (1, 2) is exerted (4, 5, 106, 21, 22, 25, 26) over the whole axial length of the rolls (1, 2). This may be obtained through mechanical (6) or magnetic (21, 22, 23, 25, 26) means.

37 Claims, 8 Drawing Sheets

CORRUGATOR UNIT, PARTICULARLY FOR SHEETS OR WEBS OF PAPER, OR SIMILAR

BACKGROUND OF THE INVENTION

The invention relates to a corrugator unit, particularly for sheets or webs of paper, or similar, of the type comprising at least two rolls having a toothed or corrugated surface, and being mutually engaged and pushed against each other by a predetermined pressure or force.

Said corrugator units are particularly used in corrugated board manufacturing equipment, in which an intermediate corrugated layer is to be interposed between two smooth paper layers.

In prior art corrugator units, the two peripherally corrugated or toothed rolls are supported by end hubs, rotatably about their axis. At least one of the two rolls is compressed against the other by means of pushers, acting on the end supports. Since rolls are considerably long (up to about 2.8 mt.), a uniform compressive force between the corrugator rolls is ensured all over their length by making use of roll deflection. Rolls, usually only one thereof, have a peripheral corrugated surface which is crowned in the axial direction to a predetermined extent, so as to obtain a uniform compression between the two corrugator rolls all along their axial length. The need for an accurate crowned profile of the corrugator rolls forces, especially in case of maximum lengths thereof, to provide very low crowning values, of about 0.2 to 0.6 mm, and therefore to use long-diameter rolls.

Besides the drawbacks related to the considerable mass of the roll, and so to a higher inconvenience in construction, and to higher costs thereof, the above arrangements also provide that flutes are formed on paper, by forcing the latter through the labyrinth formed by the teeth of the rolls, where it is subject to an undesired braking effect, due to friction, which, in some cases, causes paper resistance to be reduced or even paper to be torn.

The necessary crowning values are generally very small, of the order of a few tenths of a millimeter (0.2 to 0.6 mm) and therefore specific pressure values are critically affected by any inaccuracy in construction and by the progressive wear of roll corrugations. Hence, the construction of crowned rolls requires a considerable accuracy, and therefore involves higher manufacturing costs.

Moreover, the profile of corrugator rolls is not homokinetic, being designed according to the intended corrugation, and having variations as regards both the velocity ratio and the distance between centers at each tooth pitch. Owing to this particular construction, combined with the considerable roll masses, vibrations may be generated in the operating condition, which may be subject to important autoamplification phenomena, such as resonance, especially at critical speeds.

SUMMARY OF THE INVENTION

The invention has the object to provide a corrugator unit, particularly for sheets or webs of paper, or similar, in such a way that, by means of simple and relatively cheap arrangements, the drawbacks of prior art equipment may be obviated, without jeopardizing the productive efficiency of the corrugator unit and, on the contrary, improving it.

The invention solves the above problem by providing a corrugator unit of the type described hereinbefore, in which the mutual compression of rolls is exerted over the whole axial length thereof.

Particularly, the compressive force of the two rolls against each other is exerted all along the axial length.

The compressive force is exerted uniformly over the whole axial length of the rolls.

With reference to a particular embodiment, one of the two corrugator rolls has a considerably greater diameter, whereas the diameter of the other corrugator roll is considerably smaller than the former, and the mutual compression of said two rolls is exerted on the roll having the smaller diameter.

According to a variant embodiment, the mutual compression of the two rolls is exerted on at least one of the two rolls in at least a few areas or locations of the axial extension of the rolls. Particularly, these locations and the compressive forces associated thereto are distributed along the rolls in such a way as to obtain a uniform compression between the two rolls over the whole axial length thereof.

A first corrugator unit according to the invention has a pair of cooperating and counterrotating corrugator rolls, being supported rotatably about their axis, at their ends. The corrugator roll having the smaller diameter is further held up by a set of supporting belts, rotating on themselves, arranged along the length of the roll, and forming a sort of cradle. Pushers are provided on these belts, for exerting a predetermined force to compress the roll, with the belts, against the second corrugator roll.

Particularly, there may be provided at least one belt-tightening means for each belt, or for groups of supporting belts.

In an alternative embodiment, the compression between the two rolls is obtained through magnetic, particularly electromagnetic means.

A first variant of this embodiment provides an electromagnet having a pair of pole pieces, one pole piece for each roll, so that the magnetic circuit closes on the rolls. In this arrangement, which provides a magnetic gap between the two rolls and between the pole pieces and the two rolls, one or both rolls are pushed or pulled into relative positions, so as to reduce the resistance to the magnetic flux, thereby producing the correct mutual compression of the two rolls.

Generally, the roll having the greater diameter is supported in such a way as to be stationary with respect to movements transverse to the axis of rotation, whereas the other roll, generally the one having the smaller diameter, is rotatably supported and has a sufficient freedom of motion towards the conjunction of roll centers, i.e. in the compression direction.

This variant makes use of the tendency of the magnetic field to close the magnetic gap in order to reach the highest energy condition. In this case, the pole pieces and the magnetic gaps (the one between the two rolls and the one between the roll which is movable in the compression direction and the pole pieces associated thereto) are so dimensioned that the magnetic field generated by one or more coils involves a displacement of said movable roll, such as to generate a specific compressive force against the stationary roll.

A second variant embodiment comprises an electromagnet, whose pole pieces terminate as close as possible to the tangent point between the two rolls. Each pole piece attracts the two rolls by a force having at least one component radial and at least one component substantially circumferential or parallel to the tangent in the contact point between the two rolls. The two circumferential or tangential components, having opposite signs and equal modules, compensate each other by symmetry in the shape of the pole pieces and of their magnetic gaps.

In both cases, the pole pieces, as well as the magnetic field, extend uniformly along the whole length of the rolls.

The above description clearly shows the advantages derived from providing the roll being meant to be pushed with a considerably smaller diameter and mass than the stationary roll.

The advantages of the present invention are selfevident from the above description.

The solution according to the invention allows to overcome all difficulties and drawbacks of prior art corrugator units.

Further, said solution allows to obtain considerable advantages. Particularly, the value of specific pressure, uniformly distributed over the whole length of the roll, may be adapted to real needs, imposed by the type of paper, or similar, being produced.

The diameter of the roll may be chosen as the most appropriate for manufacturing needs, and without accounting for any stiffness requirement thereof.

A roll construction without crowning requires a lower manufacturing accuracy and therefore lower costs.

The corrugator unit according to the invention also allows to avoid any variations in specific pressure, required by roll wear.

By reducing the mass of one roll, resonance frequencies are brought to higher values with respect to manufacturing speeds.

Moreover, the number of paper-gripping teeth or corrugations may be reduced, allowing for the use of a less resistant paper.

The invention also allows to adapt and adjust the distribution of the compressive force in the individual attachment locations, or over the length of the roll, so as to compensate for any variation of the compressive force or as to eliminate any vibration auto-amplification or resonance phenomena, thereby enormously reducing the noise of the corrugator unit, with respect to currently attainable values.

The invention also addresses further improvements, which form the subject of the dependent claims.

The invention is now described in detail, with reference to some embodiments, illustrated in the accompanying drawings, in which:

DETAILED DESCRIPTION OF THE PREFERRED EMBODIMENT

Figure 1:
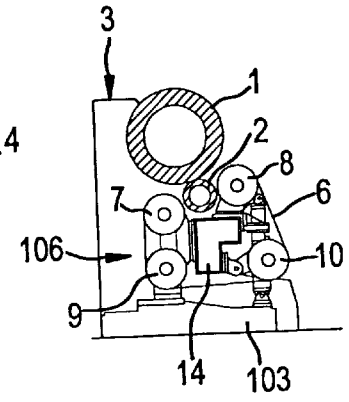
FIG. 1 is a side view of a first embodiment of the corrugator unit according to the invention.
Figure 2:
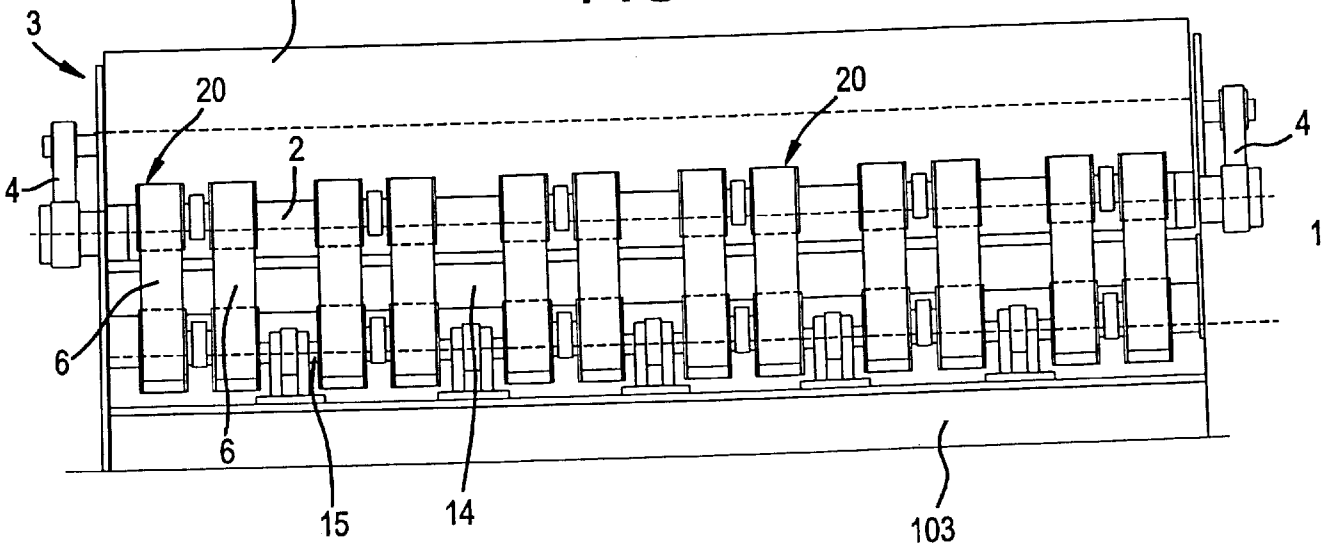
FIG. 2 is a view of the corrugator unit, as shown in FIG. 1, taken in the paper sheet feed direction.
Figure 3:
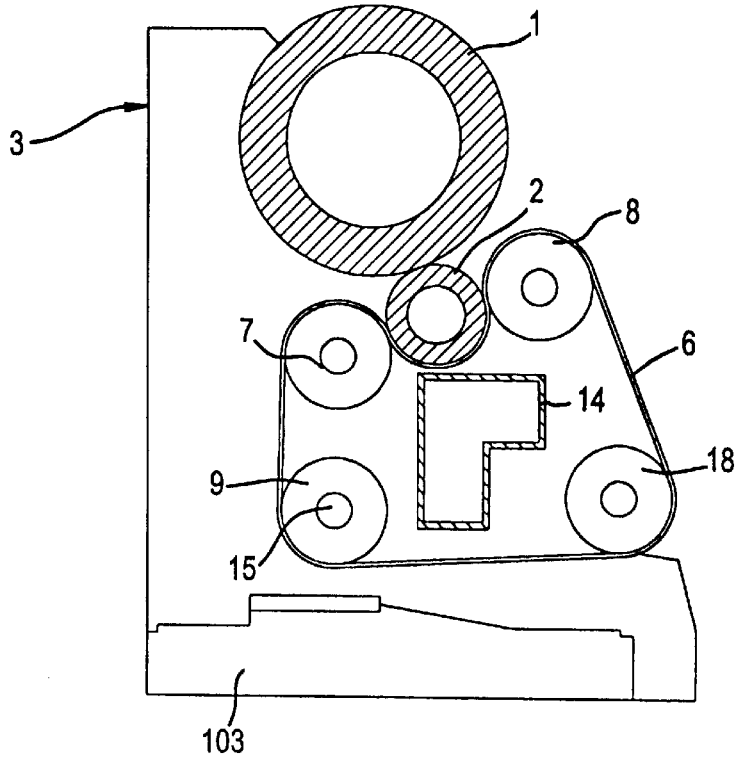
FIG. 3 is a magnified side view of the belts for compressing the lower roll.
Figure 4:
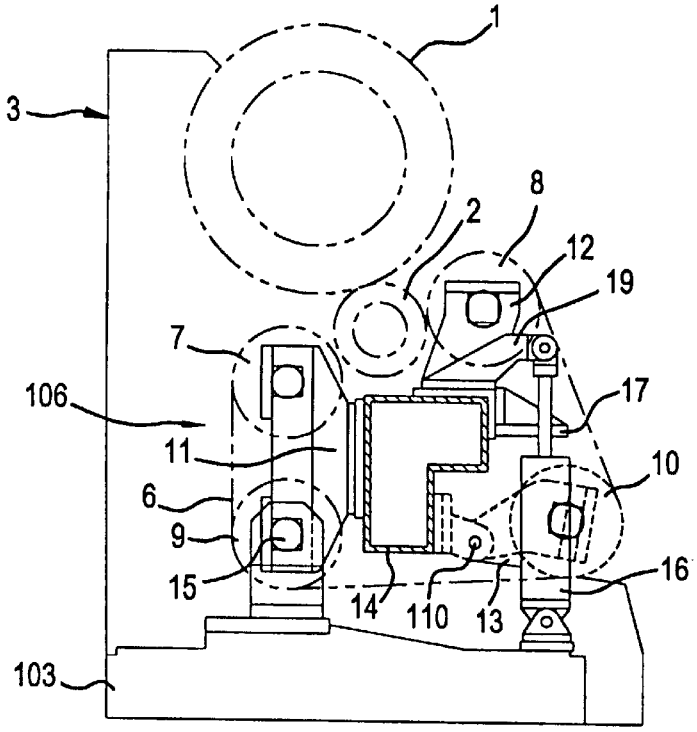
FIGS. 4 and 5 are two partially sectional views of the unit as shown in the previous figures, with respect to two different transverse planes.
Figure 5:
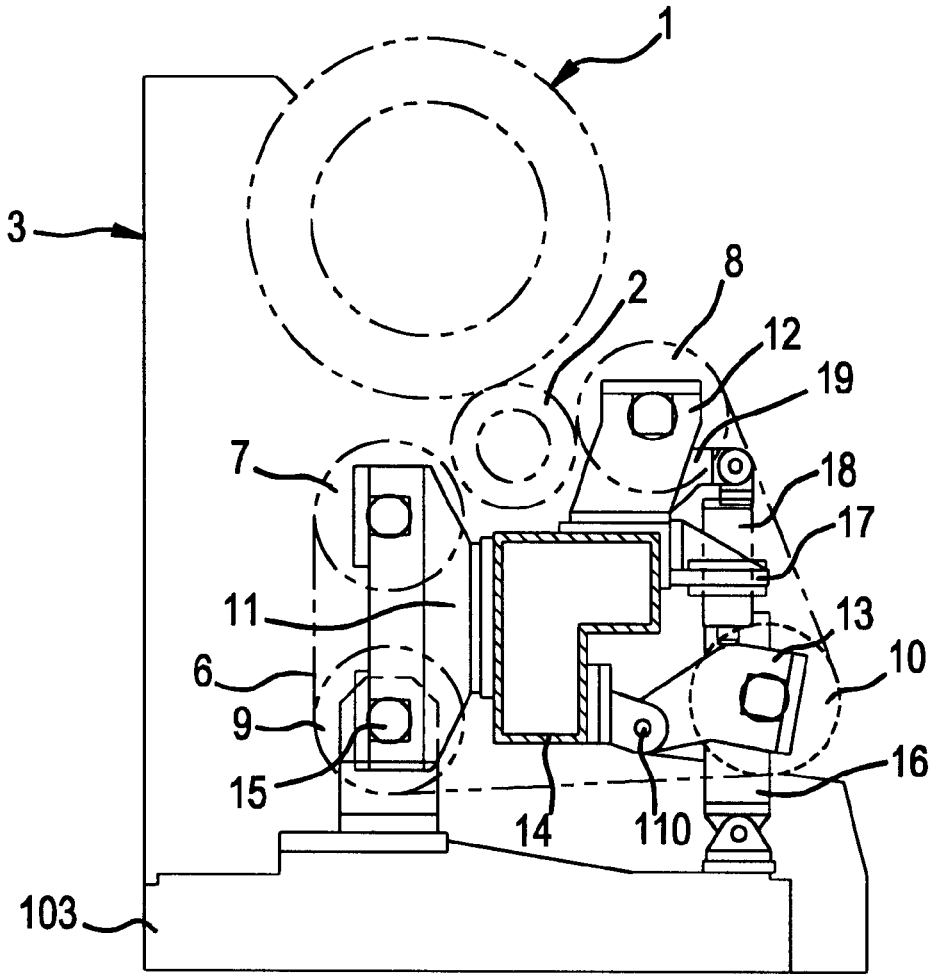
Figure 6:
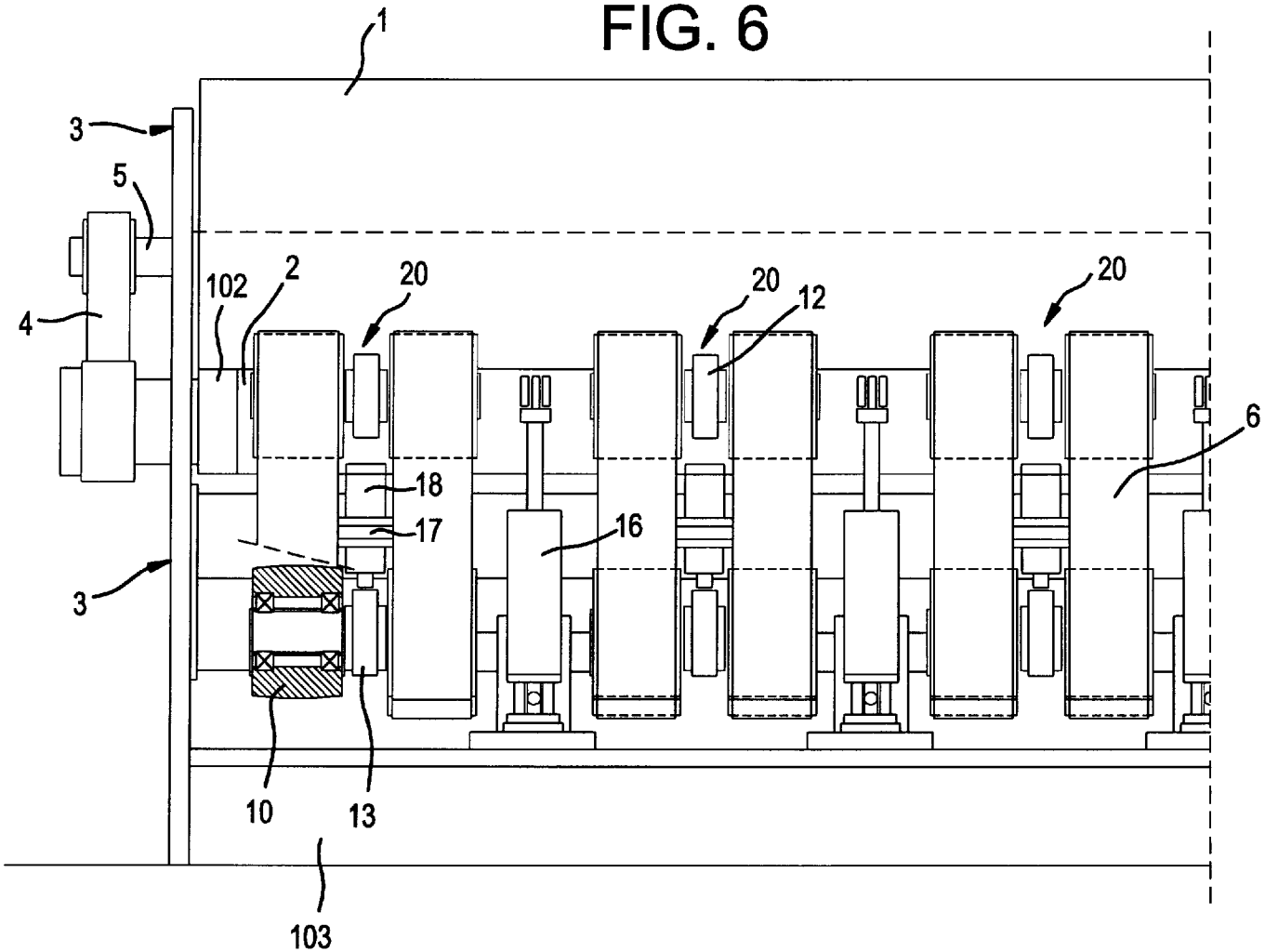
FIG. 6 shows a magnified detail of the means for supporting the lower roll and of the means for moving the belt to the rest position, in order to displace the lower roll from the upper roll.

With reference to FIGS. 1 to 6, a corrugator unit comprises at least two corrugator rolls 1 and 2, which are supported at their ends, rotatably about their axis, inside a framework 3. The rolls are rotatably driven, so as to be counterrotating. The roll 1, having a considerably greater diameter than the roll 2, according to a predetermined ratio of 1/2 to 1/10, is supported so as to be stationary with respect to transverse translations of its axis of rotation, particularly in the direction of the line passing through the axes of rotation of the two rolls 1 and 2. The second roll 2 is rotatably supported by end hubs 102, at the end of swinging arms 4, swingably pivoted on axes 5, projecting parallel to the axes of the rolls 1, 2, out of the framework 3.

Figure 7:
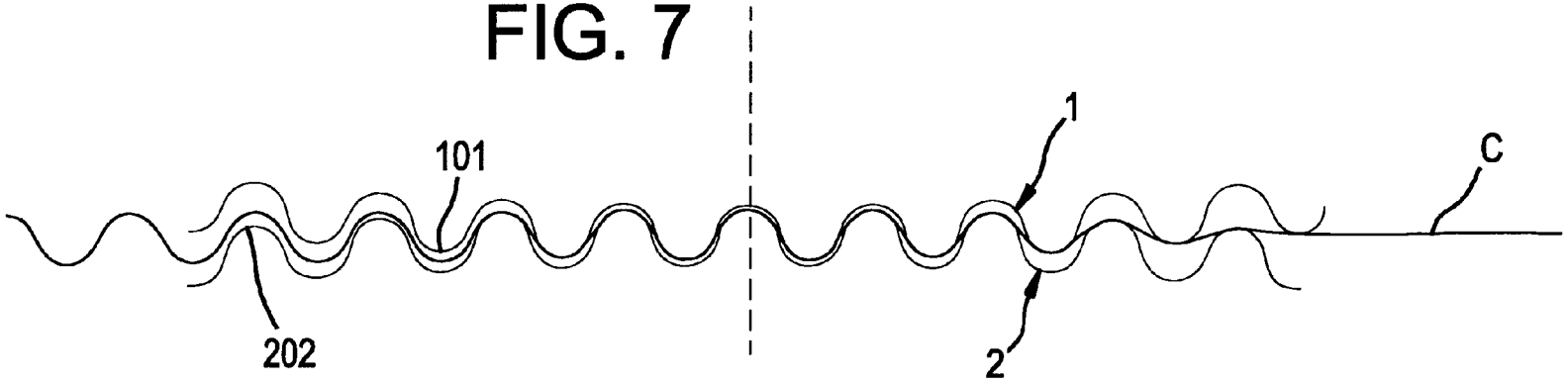
FIG. 7 shows a magnified detail of the corrugating labyrinth formed by the mutually engaged teeth, of two corrugator rolls having a substantially identical diameter.
Figure 8:
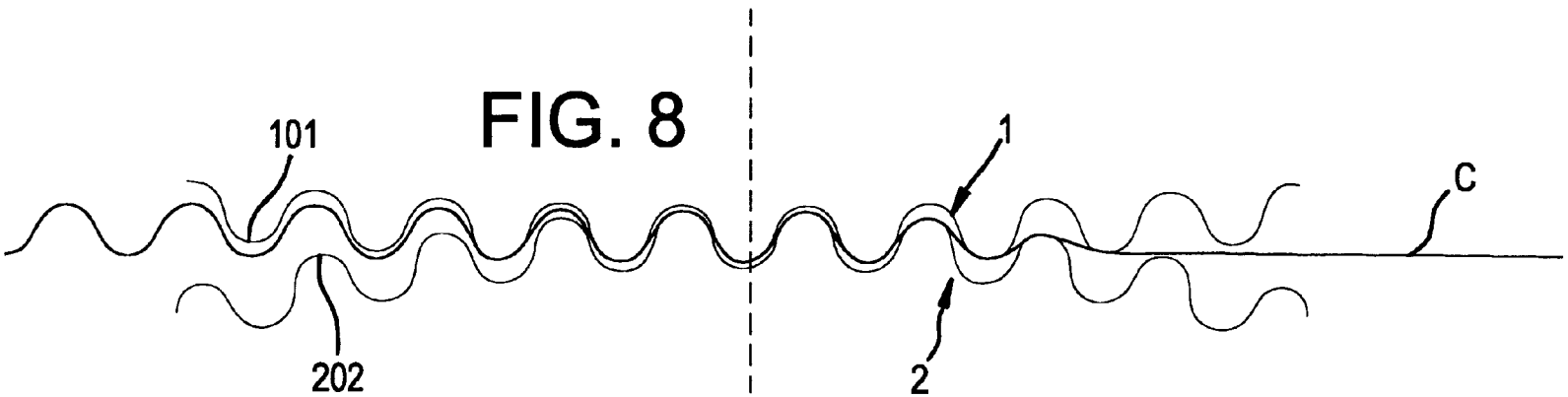
FIG. 8 is a view as shown in FIG. 7, in which the two rolls have very different diameters.

FIGS. 7 and 8 show the differences between a corrugator unit whose rolls have substantially identical diameters and a corrugator unit according to the present invention. When corrugator rolls have identical diameters the peripheral teeth or corrugations 101, 202 form a much longer labyrinth than the one formed by two corrugator rolls 1, 2, as usable according to the principle of the present invention. Due to the shorter radius of the roll 2, a smaller number of teeth or corrugations 101, 202 are in partial engagement. Therefore, the labyrinth in which the paper C is gripped is much shorter, thereby greatly reducing the risk of its being broken during the corrugation process, and involving less critical operational settings of the corrugator unit.

The roll 2 with the smaller diameter rests on a cradle 106, which is formed by a set of adjacent belts 6, closed on themselves and driven around pulleys 7, 8, 9, 10. All the belts 6 are driven in such a way as to follow coincident paths in the axial direction of the roll, the driving pulleys 7, 8, 9, 10 being identical for each belt and axially coincident.

The pulleys 7, 8, 9, 10 are arranged so that the lines joining their axes of rotation form a trapezoid, whereas the driving pulleys 7, 8, which are level with the roll 2 have their axes aligned on a plane substantially parallel to the tangent passing through the contact line between the two corrugator rolls 1, 2, which plane containing said axes is slightly staggered with respect to the axis of rotation of the roll 2, on the side opposite to the roll 1. The two pulleys 7, 8 which are level with the corrugator roll 2 have a diameter of the same order as the diameter of the latter, whereas their distance from the latter substantially corresponds to the thickness of the belt 6.

All the pulleys 7 to 10 associated to each belt 6 are supported at the ends of arms 11, 12, 13, overhangingly projecting out of a central beam 14, extending parallel to the axes of the rolls 1, 2.

The beam 14 is particularly swingably supported by a shaft 15, which is also the axis of rotation of the lower pulley 9, placed under the roll 1, whereas, on the opposite, outer side, the beam 14 is supported by the base 103, by means of linear actuators 16, such as hydraulic cylinders or similar, which allow to swing the whole beam 14 between two extreme operating and rest positions. In the operating position, shown in the figures, the belts 6 bring the roll 2 into contact with the roll 1, with the peripheral teeth and corrugations of the two rolls 1, 2 being in mutual engagement. In the rest position, the belts 6, i.e. the cradle 106 displaces the roll 2 from the roll 1, to allow for the introduction of the sheet of paper, or other similar material to be corrugated therebetween.

The actuators 16 are disposed in a predetermined arrangement over the length of the roll 2 and of the beam 14, and are articulated on one side to the base 103, and on the other side to a corresponding arm 17 of the beam 14.

At least one pulley 10 of each belt 6 is supported at the end of an arm 13, which is supported by the beam 14 so as to swing 110 about an axis parallel to that of the associated pulley 10, a linear actuator 18 being interposed between the arm 13 and a stationary matching member of the beam 14.

Thanks to this construction, the tension of each belt 6, and thus the pressure exerted by each belt on the roll 2 in the direction of the roll 1, may be adjusted.

The belts 6 are arranged in a predetermined order over the axial length of the roll 2 and particularly, in order to reduce the number of actuators, the belts 6 are supported in groups each formed by a pair of belts, said groups of belts, indicated as 20, being uniformly arranged, i.e. equally spaced all along the roll 2. Particularly, the axial distance between the belts of one group is shorter than the axial distance between the individual groups.

When the corrugator unit is in the operating condition, the belts, rotating on themselves, follow the rotation of the roll 2, while exerting a pushing action on said roll 2 against the roll 1; this pushing action is separately adjustable at each group, by a higher or lower tension of the belts 6, by means of the actuators 18.

Suitable means, well known per se, for controlling the actuators 18 allow to apply such a tension on the belts, as to obtain a uniform pushing force over the whole axial length of the roll 2 against the roll 1.

It should be noted that, since each group, or alternatively each belt 6 is provided with a separate actuator 18, the tension of the belts 6, associated to different segments of the roll 2 may be varied locally, thus allowing for a compensation of any local unevenness, and always ensuring a uniform pressure of the roll 2 against the roll 1, over their whole length.

The provision of a swinging beam 14, allows to displace the roll 2 from the roll 1, so as to be able to introduce the paper, and to clean the machine.

The actuators 16 are also arranged all along the roll 2 and the beam 14, preferably being associated to the intermediate areas between the individual groups 20 of belts 6.

One of the rolls 1, 2 or both are rotatably driven, whereas the belts 6 may be idle or also rotatably driven about the pulleys 7 to 10, so as to be synchronized with the speed of rotation of the roll 2.

Figure 9:
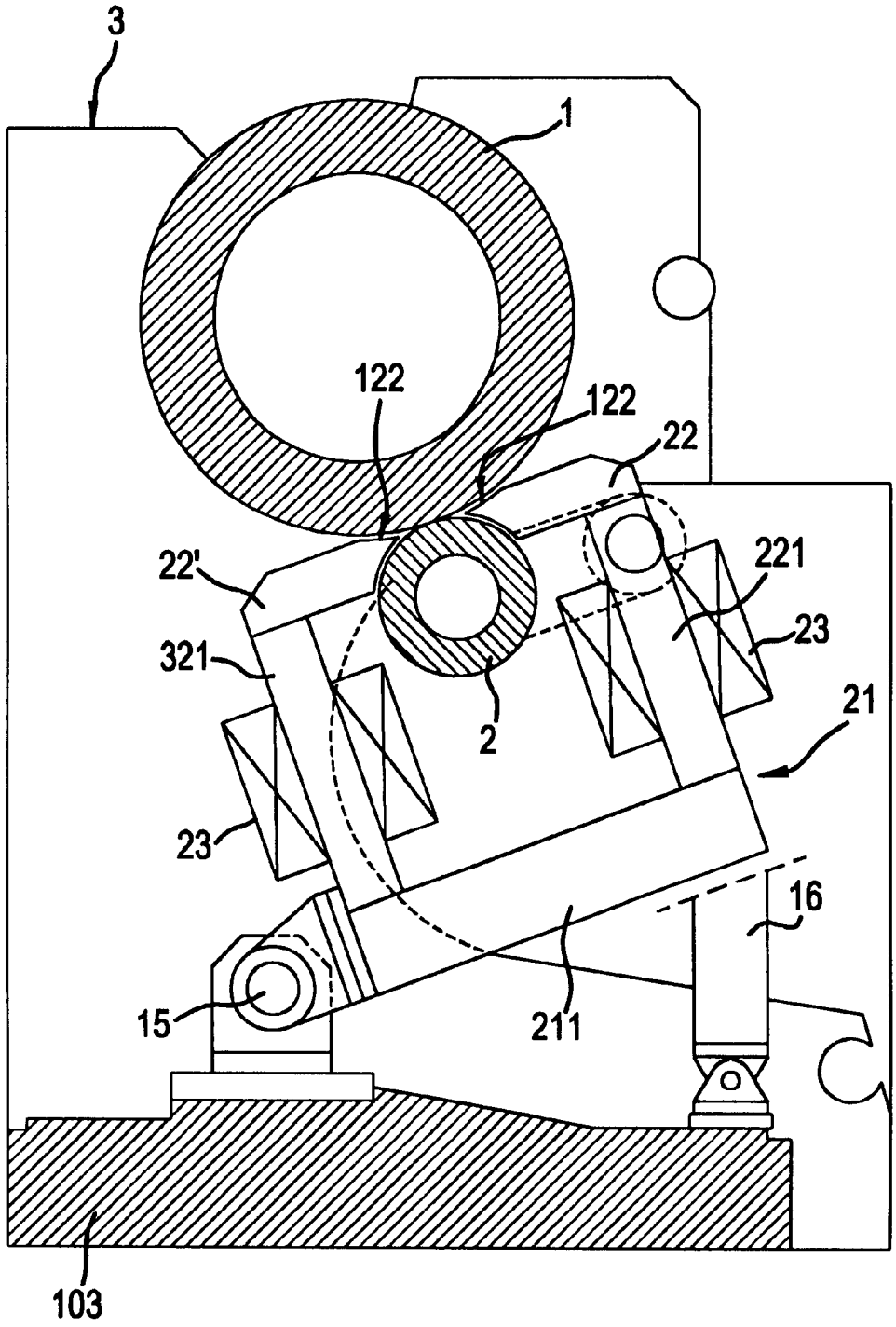
FIG. 9 is a cross sectional view of a second embodiment of the corrugator unit according to the invention.
Figure 10:
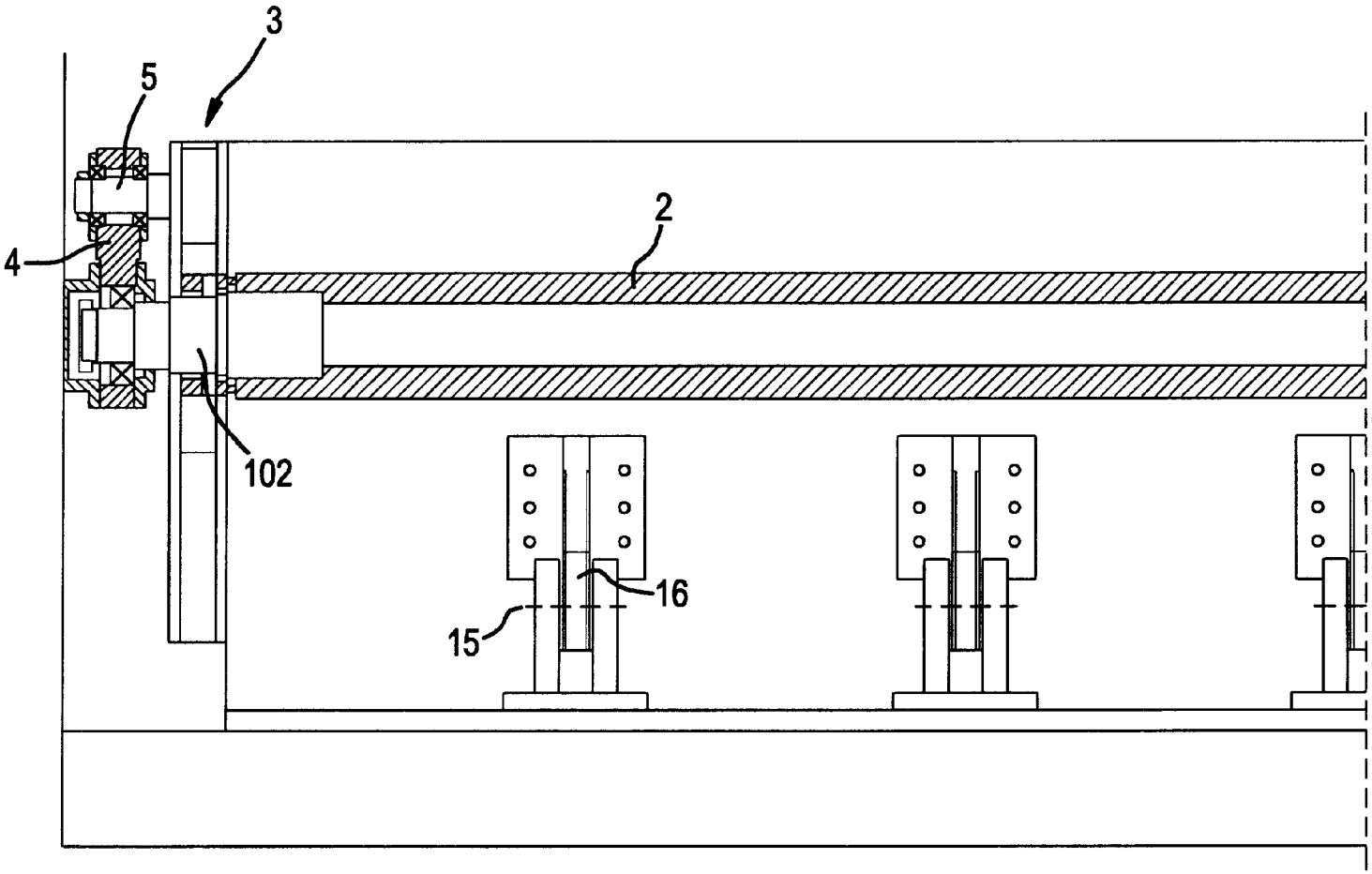
FIG. 10 is a partial view of the corrugator unit, as shown in FIG. 9, taken in the paper feed direction.

In FIGS. 9 and 10, the pressure pushing action of the roll 2 against the roll 1 is continuously exerted over the whole length of said rolls by means of a pressure device of the electromagnetic type.

The belts 6 and the supporting beam 14 associated thereto, are replaced by an electromagnet 21, placed under the roll 1, and hinged so as to swing about a shaft 15.

The electromagnet comprises a U-shaped nucleus formed by continuous ferromagnetic metal elements 121, 122, 321, including a transverse base element 121, whose extension is hinged too the base 103, and two lateral elements 221, 321 which, when the roll 2 is in the operating condition, are parallel to the plane passing through the axes of the rolls 1, 2 and through the tangent line therebetween, and are at equal distances from said plane. Each of the two walls 221, 321, is surrounded by a coil 23, whose axis is oriented transverse to the longitudinal extension of said walls 221, 321. The free ends of said walls 221 and 321 terminate with two pole pieces 22, 22', which extend parallel to the tangential plane, passing through the tangent line between the two rolls 1, 2, and project, by a wedge-shaped end 122 to the corresponding corner area between the two rolls 1, 2 as close as possible to the tangent line, and to the peripheral surfaces of the rolls 1, 2, though not coming into contact therewith. To this purpose, the tapered wedge-shaped ends have arched surfaces corresponding to the radius of curvature of the peripheral surface of the facing roll 1, 2.

When the electromagnet is in the operating condition, the two pole pieces generate magnetic fields, for attracting the two rolls 1, 2 in the mutual approaching direction. Especially, each pole piece generates a magnetic field having a radial component directed towards the line which joins the axes of the two rolls, and a tangential or circumferential component. The tangential or circumferential components of the magnetic forces generated by the magnetic field of each pole piece are opposite and have identical modules, hence they compensate each other, and the resultant is a compressive force between the two rolls 1, 2. This force is related to the magnetic field generated, and therefore to the power supply of the coils 23.

Figure 11:
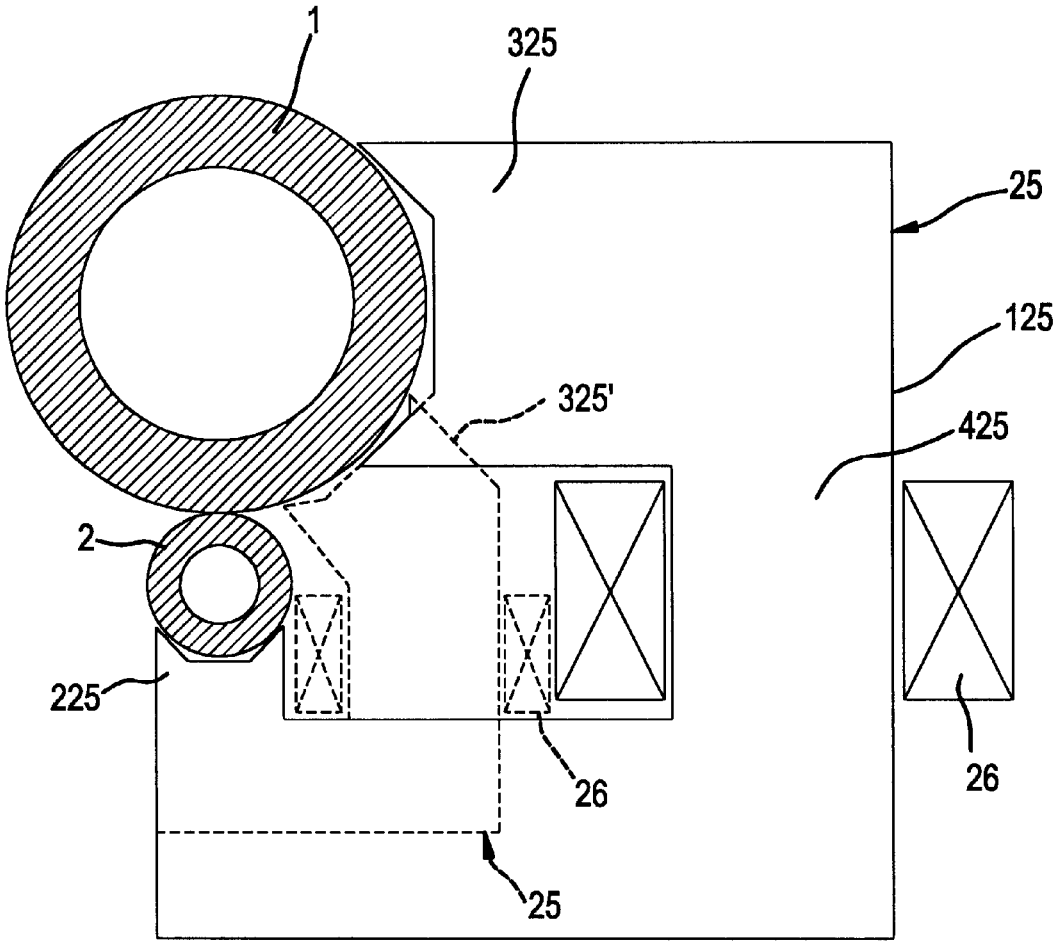
FIG. 11 is a cross sectional view of a further variant embodiment of the corrugator unit.

In the variant according to FIG. 11, the electromagnetic device generates the pushing force on the corrugator roll 2 against the corrugator roll 1, due to the tendency of a magnetic field, circulating in a ferromagnetic element, to close the existing magnetic gaps in order to reach the configuration in which the filed has the highest energy.

In this case, the two rolls 1, 2 are always superposed, whereas an electromagnet 25, comprising a ferromagnetic nucleus 125 having two extensions which terminate with surfaces facing the rolls 1, 2, and oriented not parallel and particularly but not necessarily, perpendicular to each other, is provided in the proximity of a sector of the two rolls 1, 2. The extension 225 terminates under the roll 2, whereas the extension 325, 325', terminates next to the roll 1.

Around the area 425 of the nucleus 125, between the extensions 225 and 325, a coil 26 is wound, and has a winding axis transverse to the axis of the roll 2. The nucleus 125, with the extensions 225 and 325, 325' and with the coil 26, extend without interruption over the whole length of the rolls 1, 2. The surfaces facing towards the sector of the corresponding roll are shaped in such a way as to be complementary to the roll shape, i.e. concavely arched, and correspondent to the surface of the rolls 1, 2. This complementary conformation is approximate, and the concave shape may be approximated by providing a notch having the shape of an isosceles trapezoid. The distances between said concave surfaces (magnetic gap) are appropriately selected, so as to obtain the desired compression effect of the roll 2 against the roll 1.

In the case of the variant embodiment according to FIG. 11, there may also be provided a support of the magnetic structure 25, such as to allow it to be swung or moved to a position in which the roll 2 is displaced from the roll 1, as in the previous embodiments.

Obviously, the invention is not restricted to the embodiments described and illustrated herein, but may be greatly varied, especially as regards construction, without departure from the guiding principle disclosed above and claimed below.

What is claimed is:

1. A corrugator unit comprising at least two rolls (1, 2) forming first and second rolls, having a toothed or corrugated surface (101, 202), and being mutually engaged and pushed against each other by a desired pressure or force, characterized in that a mutual compression between the first and the second rolls (1, 2) is exerted (4, 5, 106, 21, 22, 25, 26) over the whole axial length of the first and the second rolls (1, 2) wherein the second roll is supported on ends for being movable away from or towards the first roll for mutually engaging the first roll to exert the desired operative pressure and a cradle (106) is composed of a set of supporting belts (6), rotatable on themselves (7, 8, 9, 10), and arranged along the length of the second roll (2) to support the second roll (2), there being provided means (16, 17, 18, 19) for pushing the supporting belts (6) with a predetermined force towards compressing the second roll (2), in contact with the supporting belts (6), against the first roll (1).

2. A corrugator unit as claimed in claim 1, characterized in that a compressive force of the first and the second rolls (1, 2) against each other is exerted all along the axial length of one or both rolls (1, 2), the first roll (1) being supported (3) in such a way as to be stationary with respect to motion transverse to the axis of rotation, and the first and the second rolls (1, 2) being made of a perfectly cylindrical corrugated shape.

3. A corrugator unit as claimed in claim 2, characterized in that the compressive force is uniformly exerted over the whole axial length of the first and the second rolls (1, 2).

4. A corrugator unit as claimed in claim 3, characterized in that the mutual compression between the first and the second rolls (1, 2) is exerted on desired areas or locations, distributed all along the second roll (2).

5. A corrugator unit as claimed in claim 3, characterized in that the compressive force on the second roll (2) against the first roll (1) is continuously exerted (21, 22; 25, 26) over the whole axial length of the second roll (2).

6. A corrugator unit as claimed in claim 3, characterized in that the first roll (1) has a considerably greater diameter, whereas the diameter of the second roll (2) is considerably smaller than the first roll, and a mutual compression of the first and the second rolls (1, 2) is exerted on the second roll having the smaller diameter (2), which is supported in such a way as to be at least limitedly movable in the direction of the first roll (1).

7. A corrugator unit as claimed in claim 1, characterized in that the first and the second rolls form a pair of cooperating and counterrotating corrugator rolls (1, 2), which are supported rotatably about their axis, at their ends, at least one of the first and the second rolls being a corrugator roll (2), the second roll being movable towards the first roll (1), the second roll being further held up by the cradle (106) having walls in contact with the second roll, which follow or share the motion of the peripheral surface thereof, and which cradle (106) adheres against the side of the second roll (2), which is diametrically opposite to the first roll (1), at least in a plurality of contact locations or areas, distributed all over its axial length, and has such a shape as to exert a compression action of the second roll (2) against the first roll (1), which is substantially radial, there being provided means (16; 18) for pressing the cradle (106) against the second roll (2).

8. A corrugator roll as claimed in claim 7, characterized in that the cradle (106) and the second roll (2) are supported so as to be movable (4, 5, 15, 16, 17) from an operating position, in which the second roll (2) is tangent to the first roll (1) and is pushed against it, to a rest position, in which the second roll (2) is displaced to a predetermined extent from the first roll (1).

9. A corrugator unit as claimed claim 7, characterized in that at least one and/or both first and second corrugator rolls (1, 2) and/or also the movable contact areas of the cradle (106) are rotatably driven.

10. A corrugator unit as claimed in claim 1, characterized in that the supporting belts are driven around pulleys (7, 8, 9, 10), being all supported by a common frame (14), which frame (14) is movable towards displacing and approaching the second roll (2) from and to the first roll (1), between a rest position and an operating position.

11. A corrugator unit as claimed in claim 1, characterized in that for each individual belt, or for groups thereof, there are provided belt-tightening means (10, 13, 18, 19).

12. A corrugator unit as claimed in claim 1, characterized in that each belt (6) is driven around four pulleys (7, 8, 9, 10), which pulleys form the vertices of a quadrilateral, and are supported by arms (11, 12, 13) which branch off from a common central beam (14), extending all over the length of the second roll (2), whereas the cradle (106) is formed by a belt branch from the set of supporting belts (6) being in the area of the second roll (2), the pulleys (7, 8) which subtend said belt branch (6) being aligned with their axes parallel to the axis of the second roll (2) on the side diametrically opposite to the first roll (1).

13. A corrugator unit as claimed in claim 12, characterized in that the plane containing the axes of the pulleys (7, 8) which subtend the belt branch of the set of supporting belts (6), forming the cradle (106) is parallel to a plane tangent to the first and the second rolls (1, 2) and passes through a tangent line therebetween.

14. A corrugator unit as claimed in claim 6, characterized in that the first roll (1), generally the one having the greater diameter is supported in such a way as to be stationary with respect to a movement transverse to the axis of rotation, whereas the second roll (2), generally the one having the smaller diameter, is rotatably supported, and limitedly movable transverse to the axis, towards compressing against the first roll (1), particularly in a direction of a conjunction line of centers of the first and the second rolls (1, 2).

15. A corrugator unit as claimed in claim 1, characterized in that one of the first and the second rolls (2) is placed under another of the first and the second rolls, being laterally staggered therewith (1).

16. A corrugation roll apparatus comprising a first roll with a first corrugating surface and a second roll with a second, complementary corrugating surface, belts engaging the second surface, lateral supporting pulleys for supporting the belts, the belts supporting at least a central section of the second roll and urging it toward the first roll for uniformly corrugating a web moving between the first and second rolls wherein the second roll is supported on ends for being swingably pivotable along an axial length of the second roll away from or towards the first roll for mutually engaging the first roll to exert a required operative pressure.

17. A corrugating apparatus comprising a first corrugating roll, support bearings connected to the first roll, a second complementary corrugating roll, a non-stationary support adjacent at least a central portion of the second roll for urging at least the central portion of the second roll in a direction toward the first roll for uniformly corrugating a web moving between the first and the second rolls wherein the second roll is supported on ends for being pivotable along an axial length of the second roll away from or towards the first roll for mutually engaging the first roll to exert a required operative pressure wherein the non-stationary support further comprises a cradle with rotatable support belts supporting the second roll along the length of the second roll, wherein pressing the cradle moves the belts to abut the second roll with a desired force towards the first roll without the belts contacting the first roll.

18. A corrugator unit comprising first and second corrugated rolls being mutually engaged, wherein at least one of the first and the second rolls is pivotably displaceable axially towards another of the first and the second rolls for exerting pressure against selective portions on an entire axial length of the first and the second rolls when the corrugator unit is in operation and a cradle with rotatable support belts supporting the second roll along the length of the second roll, wherein pressing the cradle moves the belts to abut the second roll with a desired force towards the first roll without the belts contacting the first roll.

19. The corrugator unit of claim 18, wherein the first and the second rolls are cylindrical, and wherein the first roll is stationary with respect to motion transverse to an axis of rotation.

20. The corrugator unit of claim 18, wherein the pressure is uniformly exerted over the axial length of the first and the second rolls.

21. The corrugator unit of 18, wherein the pressure is exerted on spaced areas distributed all along the second roll.

22. The corrugator unit of claim 18, wherein the first roll has a diameter greater than the second roll.

23. The corrugator unit of claim 22, wherein the second roll exerts pressure on the first roll, the second roll being movable towards the first roll.

24. The corrugator unit of claim 18, wherein the first and second rolls are a pair of cooperating and counterrotating corrugator rolls.

25. The corrugator unit of claim 18, further comprising at least one support for rotatably supporting the first and the second rolls.

26. The corrugator unit of claim 23, further comprising the cradle having walls in contact with the second roll for sharing motion of peripheral surfaces of the second roll thereof.

27. The corrugator unit of claim 26, wherein the cradle is diametrically opposite to the first roll in a plurality of locations distributed over the axial length of the second roll.

28. The corrugator unit of claim 27, further comprising means for pressing the cradle against the second roll for exerting radial compression action of the second roll against the first roll.

29. The corrugator unit of claim 18, further comprising a frame, pulleys on the frame for rotatably supporting the belts, wherein the frame is movable away from and towards the first roll between a rest position and an operating position respectively.

30. The corrugator unit of claim 18, further comprising belt-tightening means for each belt or for groups of belts.

31. The corrugator unit of claim 29, wherein each belt is driven on four pulleys forming vertices of a quadrilateral.

32. The corrugator unit of claim 29, further comprising a central beam supporting the pulleys, arms extending from the central beam, wherein portions of the belts are rotatably supported on the pulleys forming the cradle for cradling the second roll.

33. The corrugator unit of claim 32, wherein the pulleys have axes aligned on a plane generally parallel to a tangent passing through a contact line between the first roll and the second roll.

34. The corrugator unit of claim 33, wherein a plane along the axes of the pulleys subtending portions of the belts is parallel to a tangent passing through a contact line between the first and the second rolls.

35. The corrugator unit of claim 18, wherein the second roll is below the first roll in a laterally staggered position.

36. A corrugator unit comprising:

a. at least two rolls (1, 2) forming first and second rolls with a toothed or corrugated surface (101, 202):

b. a cradle for mutually engaging the two rolls by pushing the two rolls against each other with a predetermined pressure or compression force, the compression between the first and second rolls (1, 2) being exerted (4, 5, 106, 21, 22, 25, 26) over an entire axial length of each of the two rolls (1, 2);

c. a set of parallel and adjacent belts forming the cradle and supporting one of the two rolls, plural sets of pulleys for driving each belt around the pulleys on a closed path;

d. one of the pulleys of each of the set of pulleys being mounted swingably:

e. a linear actuator for moving the pulleys;

f. the pulleys for at least two adjacent belts rotatably mounted on a common axis;

g. the pulleys of two adjacent belts being swingable together and being moved by the same actuator;

h. several groups of adjacent belts driven around the pulleys having common axes of rotation disposed along the length of the two rolls; and i. a distance between each group of two adjacent belts driven around the pulleys having common axis of rotation being greater than a distance of the two adjacent belts.

37. A corrugator unit comprising:

a pair of cooperating and counter-rotating corrugator rolls (1, 2), having a toothed or corrugated surface (101, 202), and being mutually engaged and supported at their ends rotatably about their axis, at least one roll (2) being movable towards the other roll (1) and being further held up by a cradle (106) having walls in contact with the roll sharing motion of a peripheral surface thereof, and the cradle (106) adheres against a side of the one roll (2) diametrically opposite to the other roll (1) at least in a plurality of contact locations or areas distributed all over axial lengths of the rolls, and having a shape for exerting a compression action of the one roll (2) against the other roll (1), substantially radially over the whole axial length of the two rolls (1, 2);

the cradle (106) comprising a set of adjacent supporting belts (6), rotatable on themselves (7, 8, 9, 10), each one driven around pulleys (7, 8, 9, 10), all the pulleys being supported by a common frame (14);

the belts being supported in groups, each group formed by a pair of adjacent belts, said groups of belts being uniformly distributed with by equal spacing all along the one roll (2) and having an axial distance between the belts of one group shorter than an axial distance between individual groups;

the common frame comprising a common central beam (14), extending over the length of the one roll (2), arms (11, 12, 13) branching-off from the beam, vertices on the arms for carrying the pulleys to form vertices of a quadrilateral;

at least one pulley (10) of each belt (6) is supported at the end of one arm (13) supported by the beam (14) for swinging (110) about an axis parallel to an axis of an associated pulley (10);

a linear actuator (18) being interposed between the one arm (13) and a stationary matching member of the beam (14), each arm supporting a couple of pulleys, each pulley being associated with one of the two adjacent belts forming the group of adjacent belts and being provided an actuator for each swingable arm supporting two pulleys for the two adjacent belts;

the cradle (106) being formed by the belts (6) disposed in the area of the one roll (2), the pulleys (7, 8) which subtend said belts (6) being aligned with their axes parallel to the axis of the one roll (2) on the side diametrically opposite to the other roll (1);

the common beam (14) being movable for displacing and approaching the one roll (2) from and to the other roll (1), between a rest position and an operating position, the beam (14) swingably supported by a shaft (15), which is also the axis of rotation of one pulley (9), placed under the other roll (1), whereas, on the opposite, outer side, the beam (14) is supported by the base (103), by means of linear actuators (16) which allow to swing the beam (14) between two extreme operating and rest positions; and the actuators (16) are disposed in a predetermined arrangement over the length of one the roll (2) and of the beam (14).

* * * * *